US009015978B2

(12) United States Patent
Troy et al.

(10) Patent No.: US 9,015,978 B2
(45) Date of Patent: Apr. 28, 2015

(54) MAGAZINE RELEASE DEVICE FOR FIREARMS

(71) Applicants: Stephen P. Troy, Lee, MA (US); John M. Lopes, West Springfield, MA (US)

(72) Inventors: Stephen P. Troy, Lee, MA (US); John M. Lopes, West Springfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 0 days.

(21) Appl. No.: 14/221,807

(22) Filed: Mar. 21, 2014

(65) Prior Publication Data

US 2015/0040450 A1 Feb. 12, 2015

Related U.S. Application Data

(62) Division of application No. 13/315,932, filed on Dec. 9, 2011, now Pat. No. 8,713,832.

(51) Int. Cl.
*F41A 9/24* (2006.01)
*F41A 9/61* (2006.01)
*F41A 3/66* (2006.01)

(52) U.S. Cl.
CPC ... *F41A 9/61* (2013.01); *F41A 3/66* (2013.01); *F41A 9/24* (2013.01)

(58) Field of Classification Search
None
See application file for complete search history.

(56) References Cited

U.S. PATENT DOCUMENTS

| | | | | |
|---|---|---|---|---|
| 4,599,818 | A * | 7/1986 | Fedora et al. | 42/7 |
| 5,519,954 | A * | 5/1996 | Garrett | 42/6 |
| 7,219,462 | B2 * | 5/2007 | Finn | 42/49.01 |
| 8,327,749 | B2 * | 12/2012 | Underwood | 89/138 |

* cited by examiner

*Primary Examiner* — Stephen M Johnson
(74) *Attorney, Agent, or Firm* — Robert A. Parsons; Michael W. Goltry; Parsons & Goltry

(57) ABSTRACT

A magazine release device is affixed to a firearm and operable from either side of the firearm. The device includes a shaft extending between opposite sides of the lower receiver and movable longitudinally between an engaged and a disengaged orientation. A spring biases the shaft into the engaged orientation. A plate, affixed to one end of the shaft, includes an inwardly directed catch that engages with a magazine when the shaft is in the engaged orientation and disengages from the magazine when the shaft is moved to the disengaged orientation. A right hand actuation button is affixed to the shaft on the right side of the lower receiver and a left hand actuation button is affixed to the plate on the left side and each actuation button controls the shaft and plate between the disengaged orientation and the engaged orientation.

3 Claims, 9 Drawing Sheets

MAGAZINE RELEASE DEVICE FOR FIREARMS

CROSS-REFERENCE TO RELATED APPLICATION

This application is a Divisional Application of U.S. patent application Ser. No. 13/315,932, filed Dec. 9, 2011, now U.S. Pat. No. 8,713,832, which claims the benefit of U.S. Provisional Patent Application No. 61/421,911, filed 10 Dec. 2010.

FIELD OF THE INVENTION

This invention relates to firearm control devices and more specifically the present invention relates to a magazine release device for a firearm lower receiver.

BACKGROUND OF THE INVENTION

Hand-held firearms of the auto/semi-auto version require a magazine release constructed to release an empty magazine so that a loaded magazine can be inserted into the lower receiver. In the present firearms of this type the magazine release is positioned only on the right side of the lower receiver for convenience of right-handed operators. However, since only one type or form of this firearm is provided for both left-handed and right-handed users, the magazine release is inconvenient for left-handed users.

It would be highly advantageous, therefore, to remedy the foregoing and other deficiencies inherent in the prior art.

Accordingly, it is an object of the present invention to provide new and improved firearm control devices.

It is another object of the present invention to provide a new and improved magazine release mechanism that can be conveniently operated by both left handed and right handed operators.

SUMMARY OF THE INVENTION

Briefly, to achieve the desired objects of the instant invention in accordance with a preferred embodiment thereof, a magazine release device is provided for a firearm with a lower receiver. The release device is operable from either side of the firearm and includes a shaft designed to fit within the lower receiver and extend between one side of the lower receiver and an opposite side of the lower receiver. The shaft is movable longitudinally within the lower receiver between a magazine engaged orientation and a magazine disengaged orientation and a spring is engaged with the shaft to bias the shaft into the magazine engaged orientation. A plate is affixed to one end of the shaft and designed to extend along an outer surface of the lower receiver. The plate includes an inwardly directed catch positioned on an inner surface of the plate and designed to be engaged with a magazine inserted into the lower receiver when the shaft is in the magazine engaged orientation and disengaged from the magazine when the shaft is moved to the disengaged orientation. A first actuation button is affixed to an end of the shaft opposed to the one end. The first actuation button extends outwardly from the lower receiver opposite the plate and has a depressed position and a normal position. The first actuation button controls the shaft into the disengaged orientation in the depressed position and maintains the shaft in the engaged orientation in the normal position. A second actuation button is affixed to the plate so as to extend outwardly from the lower receiver opposite the plate and has a depressed position and a normal position. The second actuation button controls the shaft and plate into the disengaged orientation in the depressed position and maintains the shaft in the engaged orientation in the normal position. Whereby, the magazine release device is operable from either side of the firearm.

The desired objects of the instant invention are further achieved in accordance with an embodiment of a firearm including an upper receiver and a lower receiver, and a magazine or clip assembly including a magazine inserted into a downwardly directed opening in the lower receiver and inserting cartridges into a firing mechanism within the upper receiver, and a magazine release device operable from either side of the firearm. The magazine release device includes a shaft positioned within the lower receiver so as to extend between one side of the lower receiver and an opposite side of the lower receiver and movable longitudinally within the lower receiver between a magazine engaged orientation and a magazine disengaged orientation. A spring is engaged with the shaft and biases the shaft into the magazine engaged orientation. A plate is affixed to one end of the shaft and extends along an outer surface of the lower receiver. The plate includes an inwardly directed catch affixed to an inner surface of the plate and engaged with a magazine inserted into the lower receiver when the shaft is in the magazine engaged orientation and disengaged from the magazine when the shaft is moved to the disengaged orientation. A first actuation button is affixed to an end of the shaft opposed to the one end. The first actuation button extends outwardly from the lower receiver opposite the plate and has a depressed position and a normal position. The first actuation button controls the shaft into the disengaged orientation in the depressed position and maintains the shaft in the engaged orientation in the normal position. A second actuation button is affixed to the plate so as to extend outwardly from the lower receiver on the side opposite the plate and has a depressed position and a normal position. The second actuation button controls the shaft and plate into the disengaged orientation in the depressed position and maintains the shaft in the engaged orientation in the normal position. Whereby, the magazine release device is operable from either side of the firearm.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
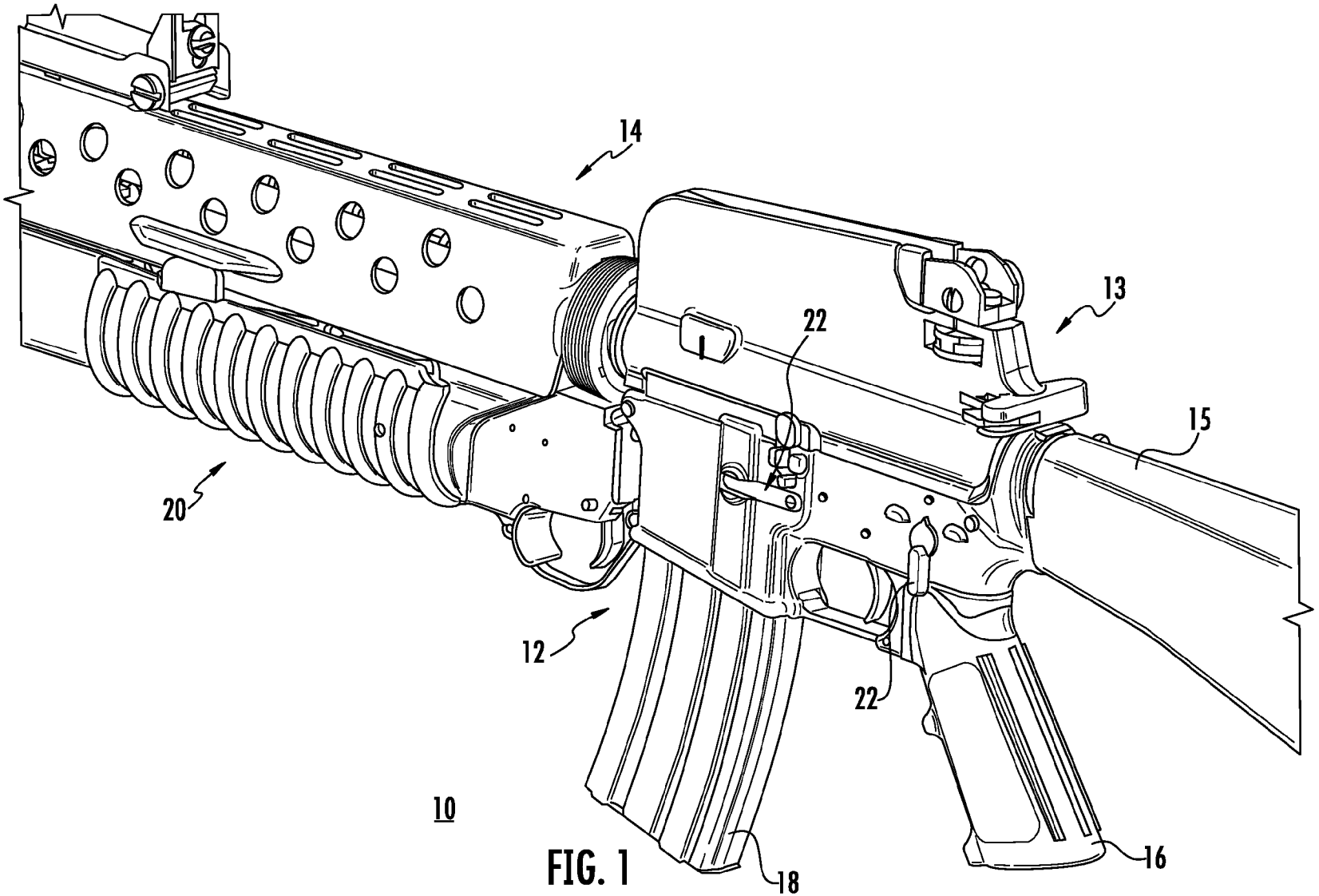
FIG. 1 is a partial left side perspective view of a prior art firearm.
Figure 2:
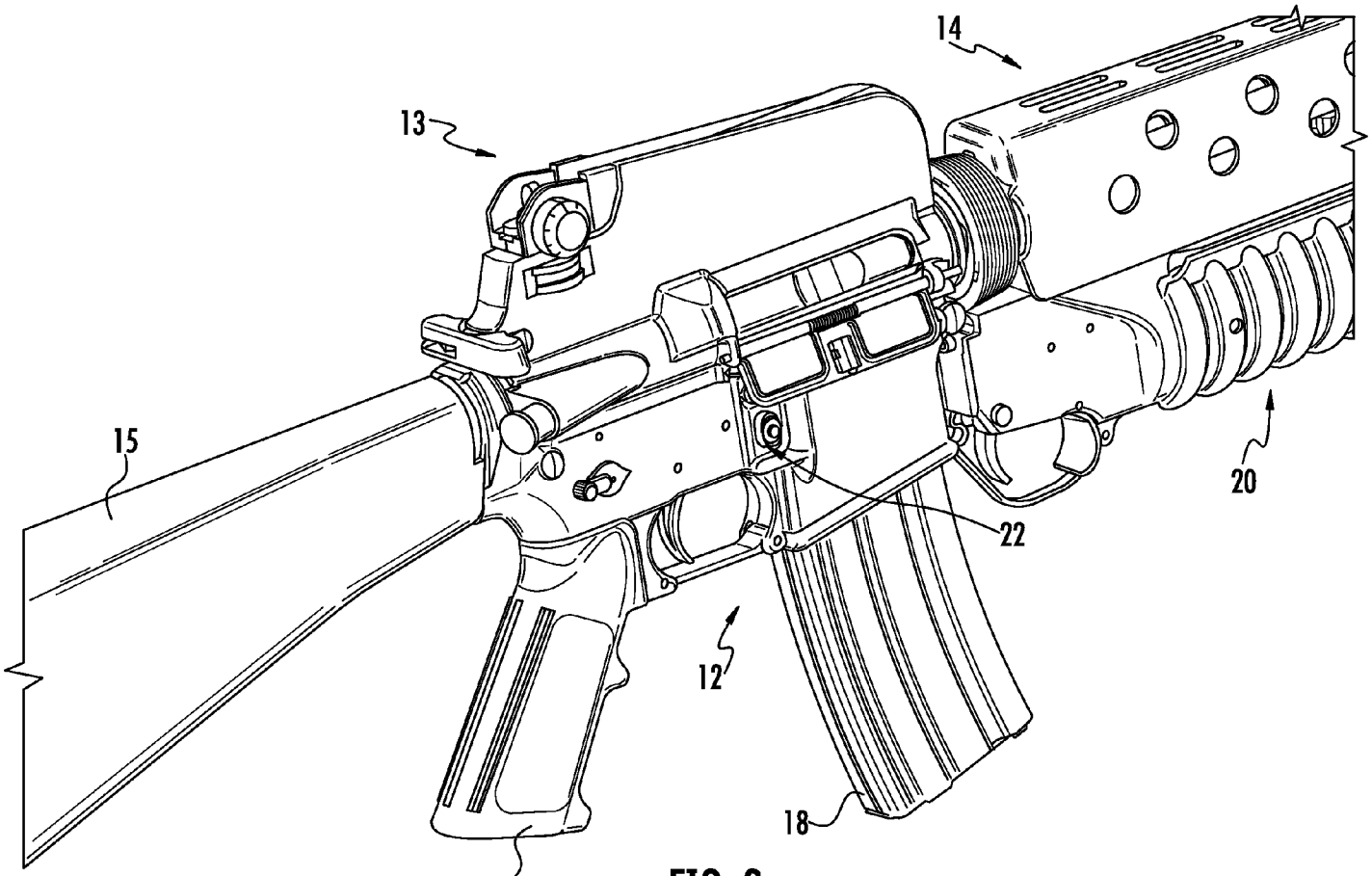
FIG. 2 is a partial right side perspective view of the prior art firearm of FIG. 1.

Turning to FIG. 1, a prior art firearm 10 is illustrated. Firearm 10 includes a lower receiver 12 and mating upper receiver 13. Upper receiver 13 includes bolt cartridge insertion and removal mechanism and a firing pin as known in the art. A barrel 14 is engaged in the front end of upper receiver 13 and a stock 15 is affixed to the rear end of lower receiver 12 by some convenient means, such as threading into a rear opening in lower receiver 12. A trigger portion of upper receiver 13 fits into a downwardly directed opening in lower receiver 12 and is integrated with the internal mechanism of upper receiver 13 and lower receiver 12 in a well known manner. A pistol grip 16 is attached to lower receiver 12 in a well known manner. A magazine or clip assembly 18 (including a clip) is inserted into a downwardly directed opening in lower receiver 12 for inserting cartridges into the mechanism within upper receiver 13 in a well known manner. A handguard assembly 20 is affixed to the front end of upper receiver 13 and surrounds and protects a portion of barrel 14.

Figure 3:
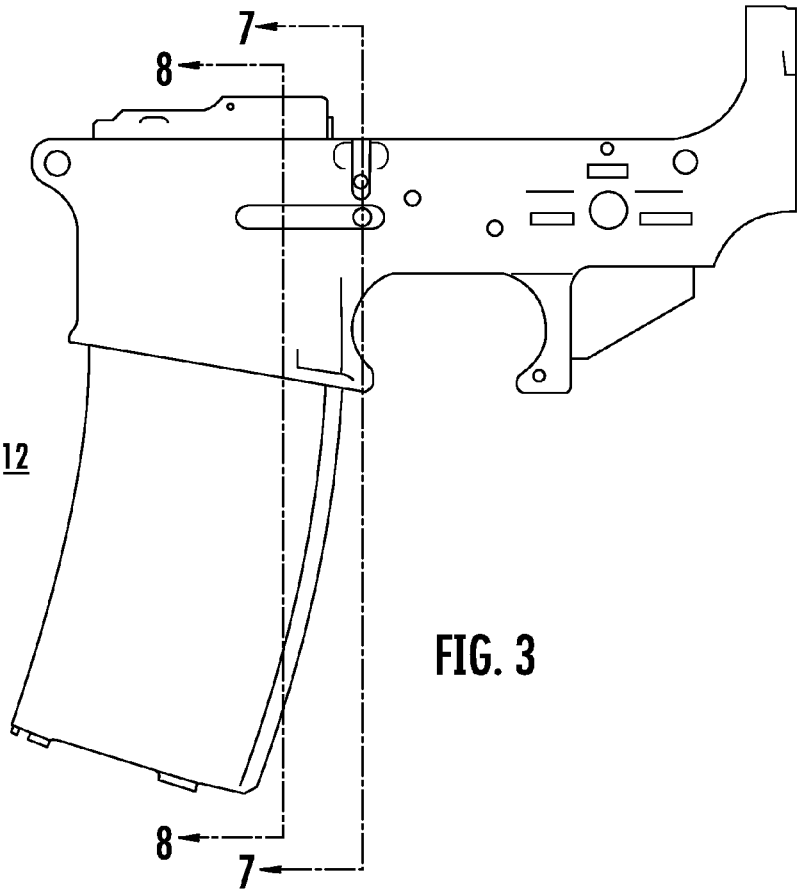
FIG. 3 is a more detailed left side view of the lower receiver of the firearm of FIG. 1.
Figure 4:
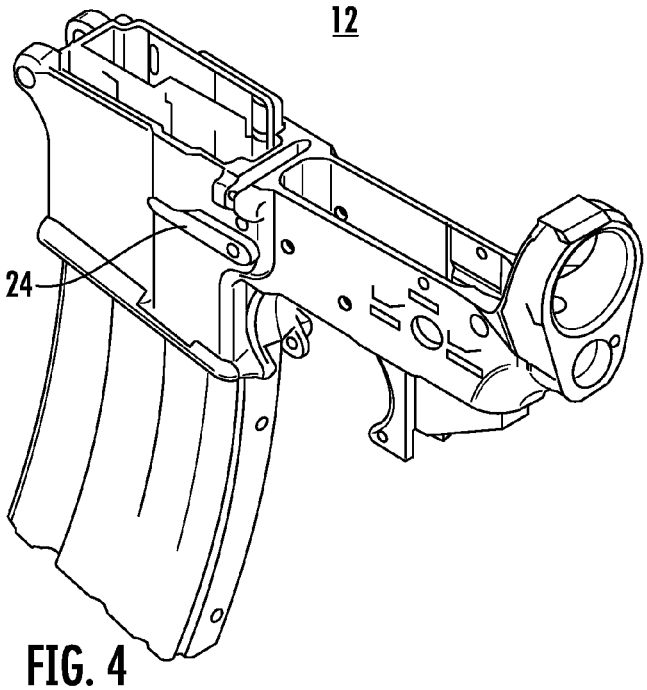
FIG. 4 is a more detailed left side perspective view of the lower receiver of the firearm of FIG. 1.
Figure 5:
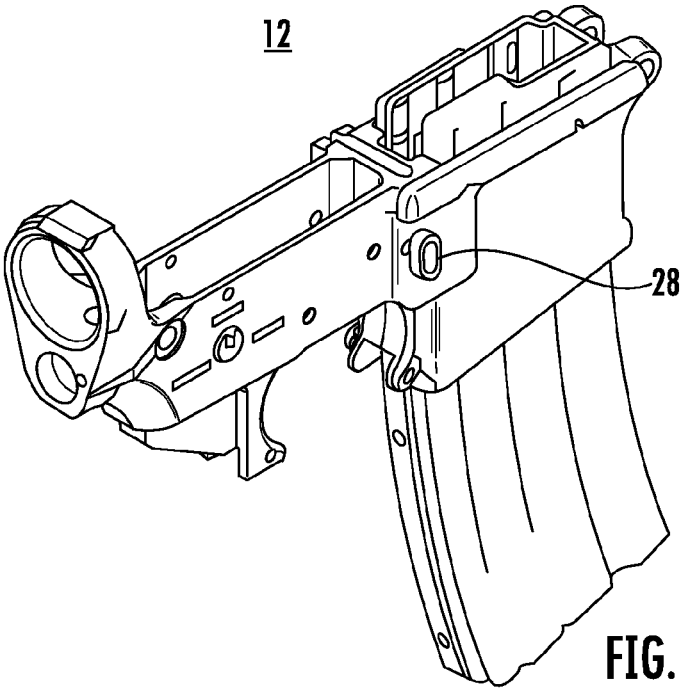
FIG. 5 is a more detailed right side perspective view of the lower receiver of the firearm of FIG. 1.
Figure 6:
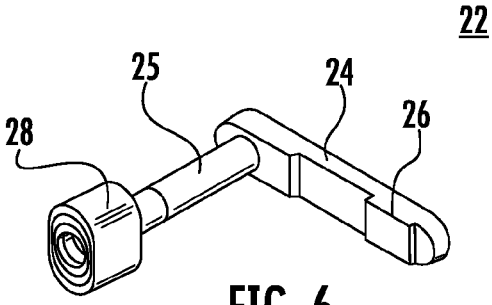
FIG. 6 is an enlarged perspective view of the magazine release mechanism disassembled from the lower receiver of the firearm of FIG. 1.

Referring additionally to FIGS. 3-5, a magazine release mechanism 22 can be seen in more detail. Also, in FIG. 6 magazine release mechanism 22 disassembled from lower receiver 12 can be seen. Magazine release mechanism 22 includes an elongated plate 24 affixed to a shaft 25 at one end. Plate 24 includes an inwardly directed catch 26 at the end opposite shaft 25 and directed in the same direction as shaft 25. The opposite end of shaft 25 has an externally accessible actuation button 28 affixed thereto.

Figure 7:
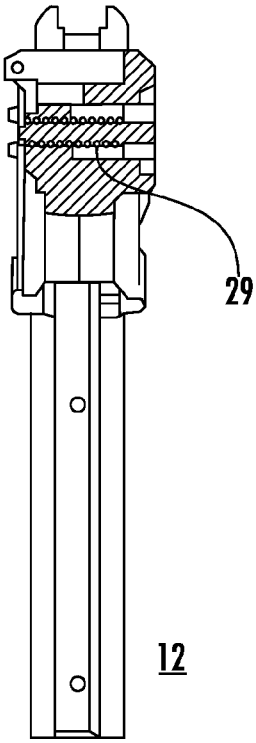
FIG. 7 is a sectional view of the lower receiver of the firearm of FIG. 1 as seen from the line 7-7 in FIG. 3.
Figure 8:
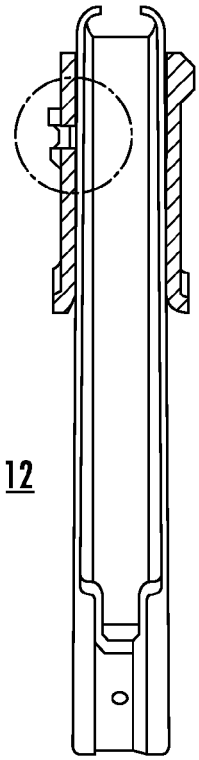
FIG. 8 is a sectional view of the lower receiver of the firearm of FIG. 1 as seen from the line 8-8 in FIG. 3.
Figure 9:
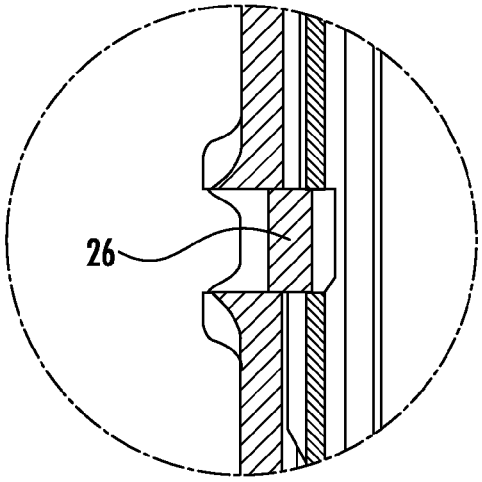
FIG. 9 is an enlarged perspective view of the catch of the magazine release mechanism of FIG. 6 in an engaged orientation with a magazine.

Magazine release mechanism 22 is engaged in lower receiver 12 with plate 24 extending along an outer left surface in lower receiver 12 as illustrated in FIG. 4. In this position shaft 25 extends through lower receiver 12 (see FIG. 7) so that actuation button 28 is externally accessible on the right side of lower receiver 12 as illustrated in FIG. 5. Catch 26 on plate 24 is engaged through an opening in the left side of lower receiver 12 with magazine 18 installed in lower receiver 12 in an operating mode. An internal compression spring 29 (seen in FIG. 7) is mounted coaxially around shaft 25 and provides a bias tending to hold catch 26 in the engaged orientation illustrated in FIG. 9.

Figure 10:
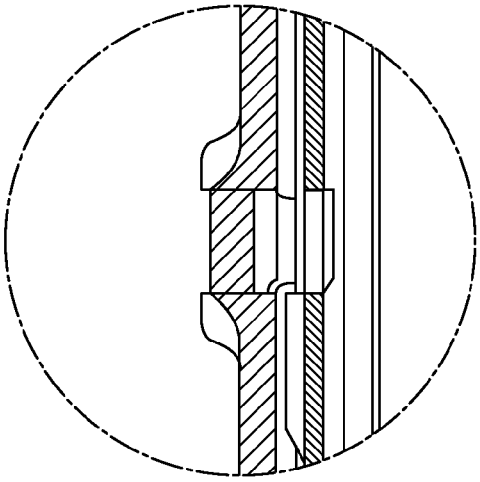
FIG. 10 is an enlarged perspective view of the catch of the magazine release mechanism of FIG. 6 in a disengaged orientation with a magazine.

To release magazine 18 for replacement, reloading, etc. the operator must access the right side of firearm 10 and depress button 28 sufficiently to remove catch 26 from engagement with magazine 18, as illustrated in FIG. 10. Magazine 18 is then free to drop or otherwise be removed from engagement with lower receiver 12. One problem with magazine release mechanism 22 is that operators can conveniently only use their right hands to depress button 28. Also, button 28 is only visible from the right side of firearm 10 so that in some circumstances there could be a delay in finding and depressing button 28. As will be appreciated by left handed operators, the provision of magazine release mechanism 22 only on the right side of firearm 10 is quite inconvenient.

Figure 11:
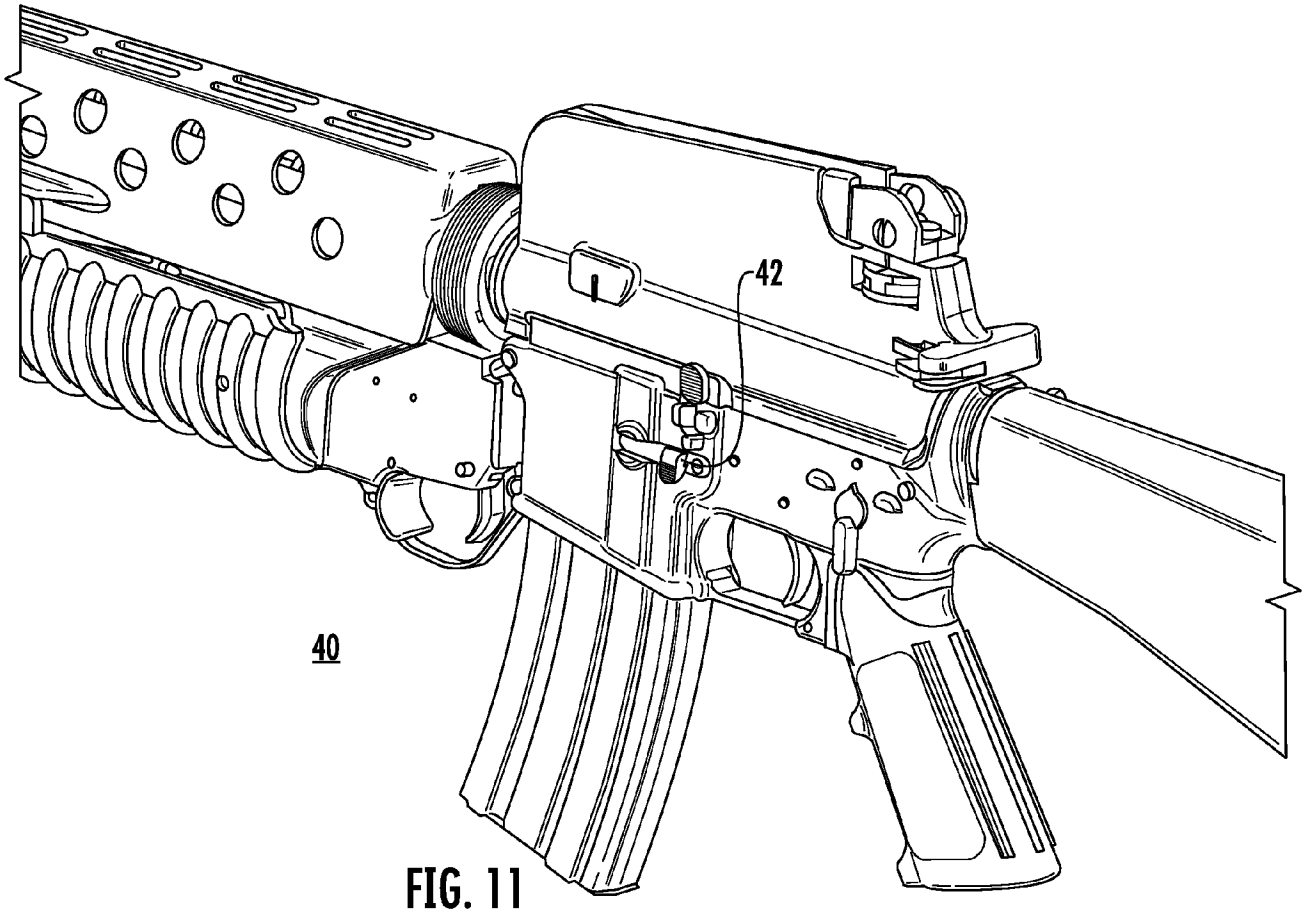
FIG. 11 is a partial left side perspective view of a firearm in accordance with the present invention.

Turning now to FIG. 11, a firearm in accordance with the present invention, generally designated 40, is illustrated. Firearm 40 is generally similar to firearm 10 except for a magazine release mechanism, generally designated 42. Because of the similarity of firearms the same numbers will be used to designate the same components throughout this disclosure. Referring additionally to FIGS. 12-15, magazine release mechanism 42 can be seen in more detail. As illustrated specifically in FIG. 15, magazine release mechanism 42 includes an elongated plate 44 affixed to a shaft 45 at one end. Plate 44 includes an inwardly directed catch 46 at the end opposite shaft 45 and directed in the same direction as shaft 45. The opposite end of shaft 45 has an externally accessible actuation button 48 affixed thereto. In addition, a left side actuation button 50 is attached to the outer surface of plate 44.

Figure 12:
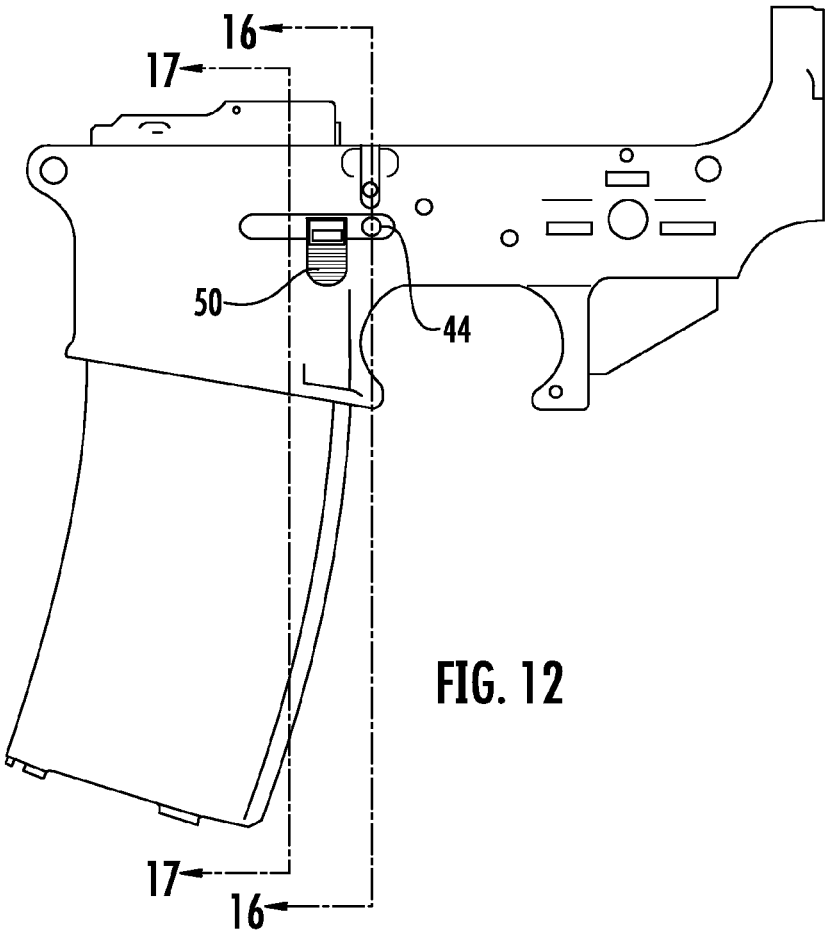
FIG. 12 is a more detailed left side view of the lower receiver of the firearm of FIG. 11.
Figure 13:
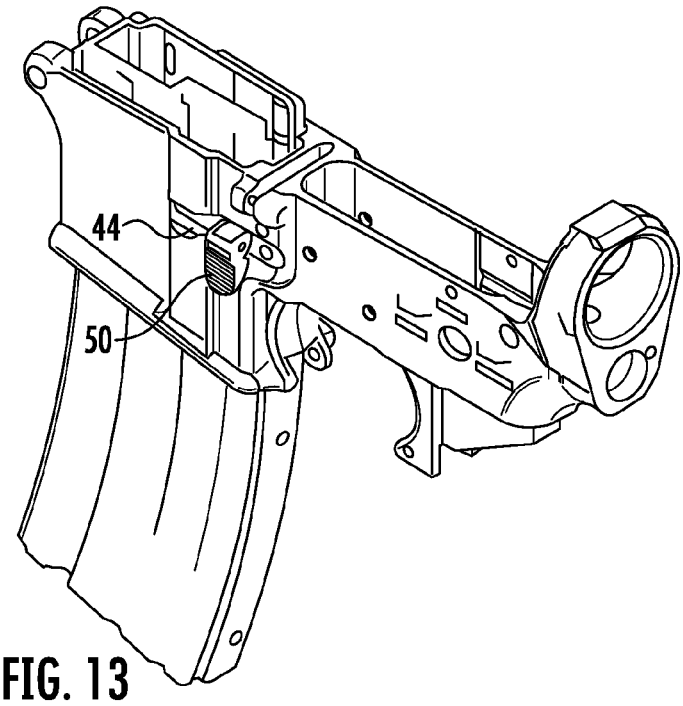
FIG. 13 is a more detailed left side perspective view of the lower receiver of the firearm of FIG. 11.
Figure 14:
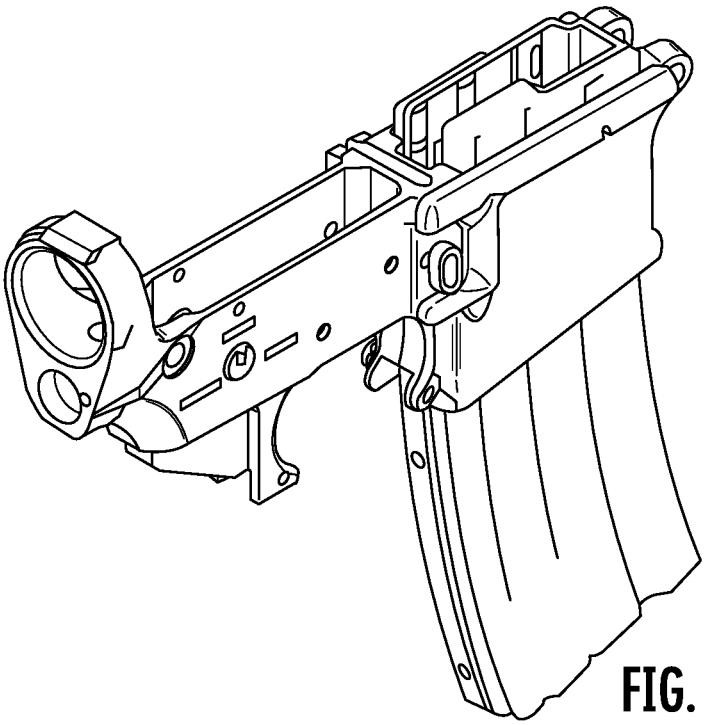
FIG. 14 is a more detailed right side perspective view of the lower receiver of the firearm of FIG. 11.
Figure 15:
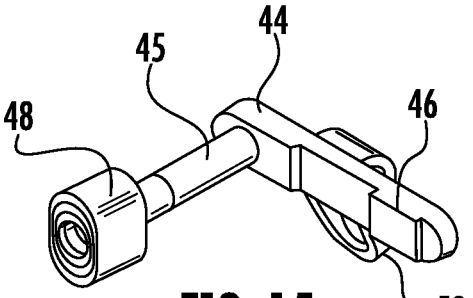
FIG. 15 is an enlarged perspective view of the magazine release mechanism disassembled from the lower receiver of the firearm of FIG. 11.
Figure 16:
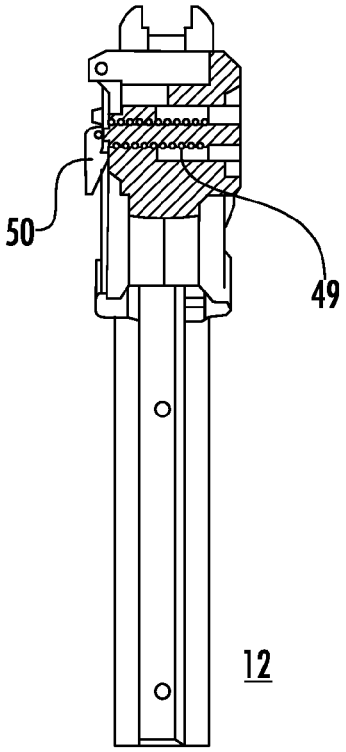
FIG. 16 is a sectional view of the lower receiver of the firearm of FIG. 11 as seen from the line 16-16 in FIG. 12.
Figure 17:
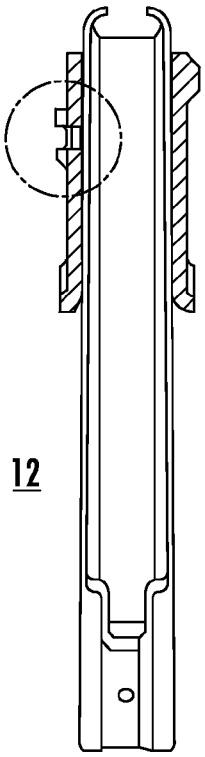
FIG. 17 is a sectional view of the lower receiver of the firearm of FIG. 11 as seen from the line 17-17 in FIG. 12.
Figure 18:
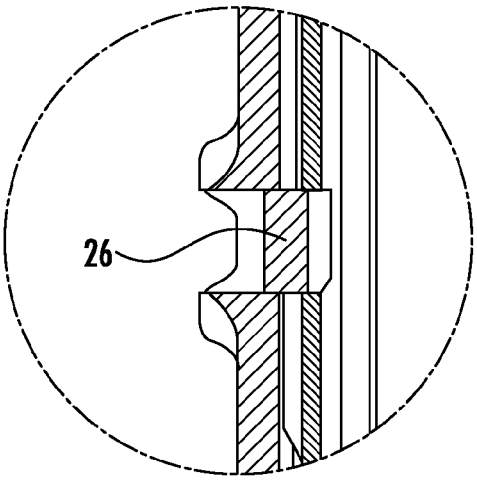
FIG. 18 is an enlarged perspective view of the catch of the magazine release mechanism of FIG. 15 in an engaged orientation with a magazine.

Magazine release mechanism 42 is engaged in lower receiver 12 with plate 44 extending along an outer left surface in lower receiver 12 as illustrated in FIG. 12. In this position left side actuation button 50 is accessible from the left side, as seen in FIGS. 11 and 13. In this position shaft 45 extends through lower receiver 12 (see FIG. 16) so that actuation button 48 is externally accessible on the right side of lower receiver 12 as illustrated in FIG. 14. Catch 46 on plate 44 is engaged through an opening in the left side of lower receiver 12 with magazine 18 installed in lower receiver 12 in an operating mode. An internal compression spring 49 (seen in FIG. 16) is mounted coaxially around shaft 45 and provides a bias tending to hold catch 46 in the engaged orientation illustrated in FIG. 18.

Here it should be noted that left side actuation button 50 is affixed to plate 44 so as to partially bear against the left surface of lower receiver 12. Left side actuation button 50 is further constructed to provide a lever action or outward pivotal movement that moves plate 44 outwardly from the surface of lower receiver 12 to disengage catch 46 from magazine 18 when button 50 is pressed. Here it should be noted the term "button" is used herein for convenience in understanding but the device might actually take a large variety of shapes including an elongated lever and pivot.

Figure 19:
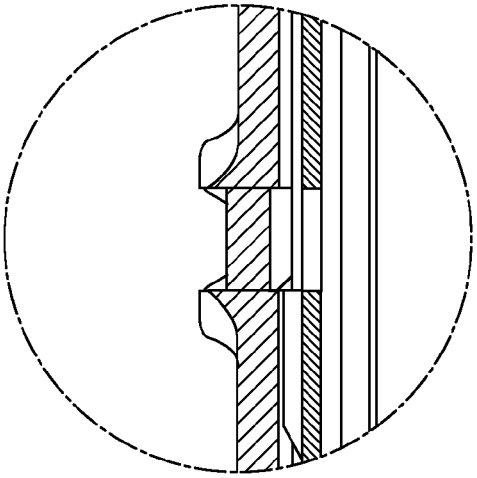
FIG. 19 is an enlarged perspective view of the catch of the magazine release mechanism of FIG. 15 in a disengaged orientation with a magazine.

To release magazine 18 for replacement, reloading, etc. the operator may access the right side of firearm 40 and depress button 48 sufficiently to remove catch 46 from engagement with magazine 18, as illustrated in FIG. 19. This is generally the procedure used by a right handed operator and may, for example, be simply and quickly accomplished by moving the trigger finger from the trigger to button 48. Alternatively, a left handed operator may access the left side of firearm 40 and depress button 50 sufficiently to remove catch 46 from engagement with magazine 18. Again, because of the accessibility of button 50, the left handed operator may, for example, simply and quickly move the trigger finger from the trigger to button 50. In either case, magazine 18 is then free to drop or otherwise be removed from engagement with lower receiver 12.

In some specific applications it may be feasible to attach a left-hand operable button, similar to button 50, to plate 44 without modifying any of the components. The left-hand operable button could be a temporary or removable element or could be attached permanently in some fashion. For example, the left-hand operable button could be designed to be affixed to the plate after the upper receiver, the lower receiver, and magazine release device with the plate and first actuation button are assembled. One problem with this arrangement is that the left-hand operable button might not be as reliable as the embodiment described above and, therefore, might not be acceptable for military use.

Thus, a new and improved firearm control device is illustrated and described. The improved control device is a magazine release mechanism that is designed to conveniently accommodate release of the magazine from either the left or the right side of the firearm. This is a substantial improvement that facilitates either right handed or left handed operation of the firearm.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A firearm comprising:

an upper receiver and a lower receiver interengaged, and a magazine or clip assembly including a magazine inserted into a downwardly directed opening in the lower receiver and inserting cartridges into a firing mechanism within the upper receiver; and a magazine release device operable from either side of the firearm and including:

a shaft positioned within the lower receiver and extending between one side of the lower receiver and an opposite side of the lower receiver, the shaft being movable longitudinally within the lower receiver between a magazine engaged orientation and a magazine disengaged orientation, and a spring engaged with the shaft and biasing the shaft into the magazine engaged orientation;

an elongated plate affixed to one end of the shaft and extending along an outer surface of the lower receiver, the plate comprising a single piece rigidly affixed to the shaft for lateral movement away from the outer surface of the lower receiver with longitudinal movement of the shaft to the disengaged orientation, the plate including an inwardly directed catch affixed to an inner surface of the plate and engaged with a magazine inserted into the lower receiver when the shaft is in the magazine engaged orientation and disengaged from the magazine when the shaft is moved to the disengaged orientation;

a first actuation button affixed to an end of the shaft opposed to the one end, the first actuation button extending outwardly from the lower receiver opposite the plate and having a depressed position and a normal position, the first actuation button controlling the shaft into the disengaged orientation in the depressed position and maintaining the shaft in the engaged orientation in the normal position; and a second actuation button affixed to the single piece plate and having a depressed position and a normal position, the second actuation button controlling the shaft and plate into the disengaged orientation in the depressed position and maintaining the shaft and plate in the engaged orientation in the normal position, the second actuation button extending beyond the plate in a direction perpendicular to the plate and including a pivot portion that bears against the surface of the lower receiver to provide a lever action or outward pivotal movement when the second actuation button is depressed so as to pivot about the pivot point and move the plate outwardly from the surface of the lower receiver into the disengaged position.

2. A firearm as claimed in claim 1 wherein the one side of the lower receiver is the right side and the opposite side of the lower receiver is the left side, and the one end of the shaft is the left end of the shaft and the end of the shaft opposed to the one end is the right end of the shaft, whereby the first actuation button is positioned adjacent the right side of the lower receiver and the second actuation button is positioned adjacent the left side of the lower receiver.

3. A firearm as claimed in claim 1 wherein the second actuation button is designed to be affixed to the plate after the upper receiver, the lower receiver, and magazine release device with the plate and first actuation button are assembled.

* * * * *